US006450257B1

(12) United States Patent
Douglas

(10) Patent No.: US 6,450,257 B1
(45) Date of Patent: Sep. 17, 2002

(54) MONITORING FLUID FLOW THROUGH A FILTER

(75) Inventor: Neil I. Douglas, Clevedon (GB)

(73) Assignee: ABB Offshore Systems Limited, Bristol (GB)

( * ) Notice: Subject to any disclaimer, the term of this patent is extended or adjusted under 35 U.S.C. 154(b) by 0 days.

(21) Appl. No.: 09/596,831

(22) Filed: Jun. 19, 2000

(30) Foreign Application Priority Data

Mar. 25, 2000 (GB) ..... 0007238

(51) Int. Cl.[7] ..... E21B 47/06; E21B 44/00

(52) U.S. Cl. ..... 166/250.02; 166/250.01; 166/66; 166/278

(58) Field of Search ..... 166/250.01, 250.02, 166/250.04, 250.07, 250.13, 252.5, 66, 278, 250.11

(56) References Cited

U.S. PATENT DOCUMENTS

| | | | | |
|---|---|---|---|---|
| 4,375,164 A | | 3/1983 | Dodge et al. | |
| 4,890,487 A | * | 1/1990 | Dussan et al. | 73/152 |
| 5,925,879 A | | 7/1999 | Hay | |
| 6,374,913 B1 | * | 4/2002 | Robbins et al. | 166/113 |
| 2002/0007945 A1 | * | 1/2002 | Neuroth et al. | 166/66 |

FOREIGN PATENT DOCUMENTS

| | | | |
|---|---|---|---|
| DE | 198 08 222 | 9/1999 | |
| EP | 0 424 120 A2 | 10/1990 | |
| GB | 1 485 853 | 10/1974 | |
| GB | 2 254 141 | 9/1992 | |
| GB | 2 299 203 | 9/1996 | |
| GB | 2 339 902 | 2/2000 | |
| GB | 2 341 679 A | 3/2000 | |
| WO | WO-98/50680 | * 11/1998 | E21B/47/00 |
| WO | 98/57030 | 12/1998 | |
| WO | WO 99/64781 | 12/1999 | |

OTHER PUBLICATIONS

A.D. Kersey, M.A. Davis, H.J. Patrick, M. LeBlanc, K.P. Koo, C.G. Askins, M.A. Putnam, E.J. Friebele, "Fiber Grating Sensors", Journal of Lightwave Tech., vol. 15, No. 8, pp. 1442–1463, 1997.*

Society of Petroleum Engineers, *A Fiber–Optic Inspection System for Prepacked Screens*, sYED hamid, Et Al., pp. 1–11, SPE 53797.

* cited by examiner

*Primary Examiner*—David Bagnell
*Assistant Examiner*—Daniel P Stephenson
(74) *Attorney, Agent, or Firm*—Kirschstein, et al.

(57) ABSTRACT

It is desirable to be able to monitor the condition of a filter in a fluid flow system, for example a sandscreen 3,4 in a fluid well. The invention provides monitoring apparatus including an optical fibre 6 having a pressure sensor 7. Pressure is exerted on the sensor, by fluid flowing through the sandscreen, via ports 10 and 11. The pressure sensor is responsive to a light signal, and to the exerted pressure, to produce a sensing light signal indicative of a characteristic of the fluid flow, such as pressure differential or fluid velocity. This, in turn, is indicative of the condition of the sandscreen or filter.

15 Claims, 7 Drawing Sheets

MONITORING FLUID FLOW THROUGH A FILTER

FIELD OF THE INVENTION

This invention relates to apparatus for, and a method of, monitoring fluid flow through a filter. An example of this is the monitoring of oil or gas flow through a sandscreen in a well.

BACKGROUND OF THE INVENTION

In unconsolidated sandstone reservoirs within fluid well bores, a sandscreen is normally installed as part of the completion of the well. A sandscreen typically comprises a tubular mesh or perforated metal sheet loaded with gravel. The loading can be done either prior to installation or, preferably, downhole. The presence of gravel prevents sand particles from the reservoir formation penetrating into the well production tubing. In other words, the sandscreen acts as a filter, allowing only fluids through. A problem with such sandscreens is that they can become blocked with impervious contaminants. Consequently, the velocity of the fluid being extracted is lower in the vicinity of the blockage and is higher proximate the remaining clear area. This sets up a pressure differential which could, in time, damage the screen and consequently result in production loss. It is difficult for an operator to detect blockage of the screen as there may not be an overall reduction in flow rate. The blockage may only become apparent when it is severe.

For this reason, it is desirable to be able to monitor flow through the screen. Conventionally, a wire-line tool incorporating a fluid velocity measurement sensor is employed. The sensor is lowered down the well production tubing on an occasional basis; the intervals between measurements are determined by skilled operators.

Certain problems may be encountered with conventional sensors. For example, there is a risk that the well may be damaged whilst the tool is being lowered into, or removed from, the well. Furthermore, operators are reluctant to lower the tool into the well unless essential, thus putting the sandscreen at risk of damage should the screen become more blocked as a result of delay.

SUMMARY OF THE INVENTION

The invention provides apparatus for monitoring the condition of a sandscreen in a fluid well system, the apparatus comprising an optical fibre incorporating at least one pressure sensor responsive to a light signal transmissible through the fibre and to pressure exerted on it by fluid flowing through the sandscreen, so that the sensor is arranged to produce a sensing light signal indicative of a characteristic of the fluid flow which, in turn, is indicative of the condition of the sandscreen.

The provision of a sensor in an optical fibre, which has a small diameter, permits the apparatus to be permanently installed downhole. Thus, monitoring of the sandscreen can be carried out continuously, with no risk of damage to the well.

The principles behind the invention are not limited to the monitoring of sandscreens. Accordingly, the invention further provides apparatus for monitoring the condition of a filter in a fluid flow system, the apparatus comprising an optical fibre incorporating at least one pressure sensor responsive to a light signal transmissible through the fibre and to pressure exerted on it by fluid flowing through the filter, so that the sensor is arranged to produce a sensing light signal indicative of a characteristic of the fluid flow which, in turn, is indicative of the condition of the filter.

BRIEF DESCRIPTION OF THE DRAWINGS

Like reference numerals have been applied to like parts throughout the specification.

DESCRIPTION OF THE INVENTION

Figure 1:
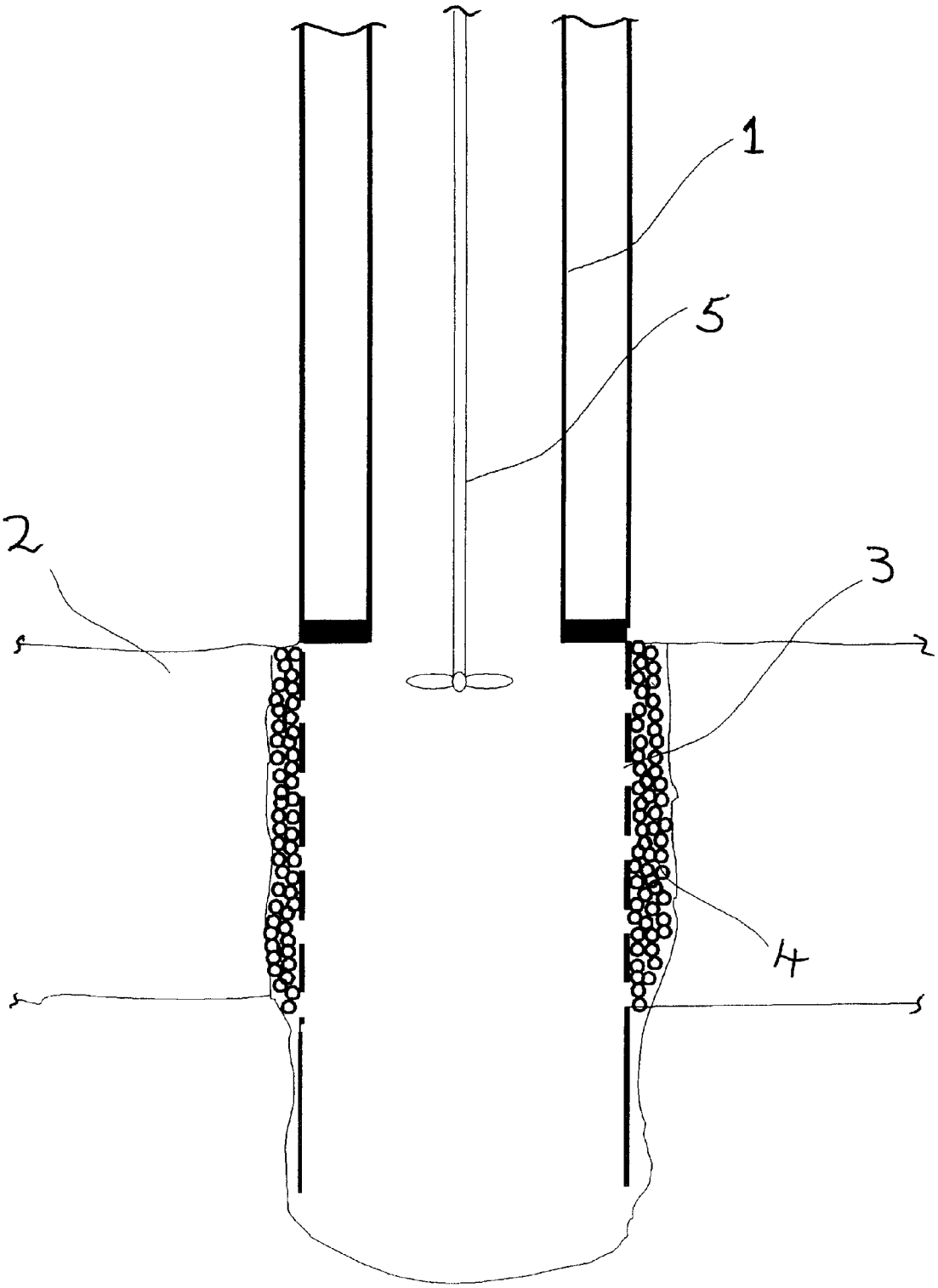
FIG. 1 is a sectional view of a region of a fluid well being monitored in a conventional manner.

With reference to FIG. 1, a region of production tubing 1 of a well is shown extending underground to a hydrocarbon bearing zone 2. Fluid to be extracted from the zone 2, for example oil or gas, enters the production tubing 1 via a tubular sandscreen 3, which filters out sand particles in the inflowing fluid. The main structure of the sandscreen typically comprises a wire mesh or a perforated steel liner. Gravel 4 is located on the outer surface of the mesh or liner; it is the gravel which filters out sand particles. There are generally two types of sandscreen. The first type is a mesh having gravel pre-installed. This type of sandscreen is, however, susceptible to damage during installation. The second type of sandscreen does not initially include gravel; instead the gravel is installed once the screen is in place downhole. This type of screen is generally more efficient as more gravel can be put in place. Upon failure of the screen, gravel can be replaced.

The problem with any type of sandscreen is that it can become blocked, and so monitoring of the fluid flow through the sandscreen 3 is essential. For this purpose, wire-line tools such as the sensor 5 shown in FIG. 1, have been developed. The sensor 5 is known as a "spinner", and measures fluid velocity in a similar manner to an anemometer. During monitoring, the spinner is lowered down the production tubing 1, and fluid velocity measurements are made as the device is lowered through the extent of the screen 3.

Changes in the velocity, as the device is lowered, indicate the possible presence of a blockage in the screen. When the degree of blockage is considered unacceptable, remedial activities are carried out, such as washing contaminants from the gravel 4, or chemical treatment.

This technique has its problems; wire-tools are invasive and so each monitoring exercise carries a certain level of risk to the well. Such monitoring exercises are also expensive. For these reasons, operators are reluctant to initiate such monitoring, thereby putting the sandscreen at risk of damage.

Figure 2:
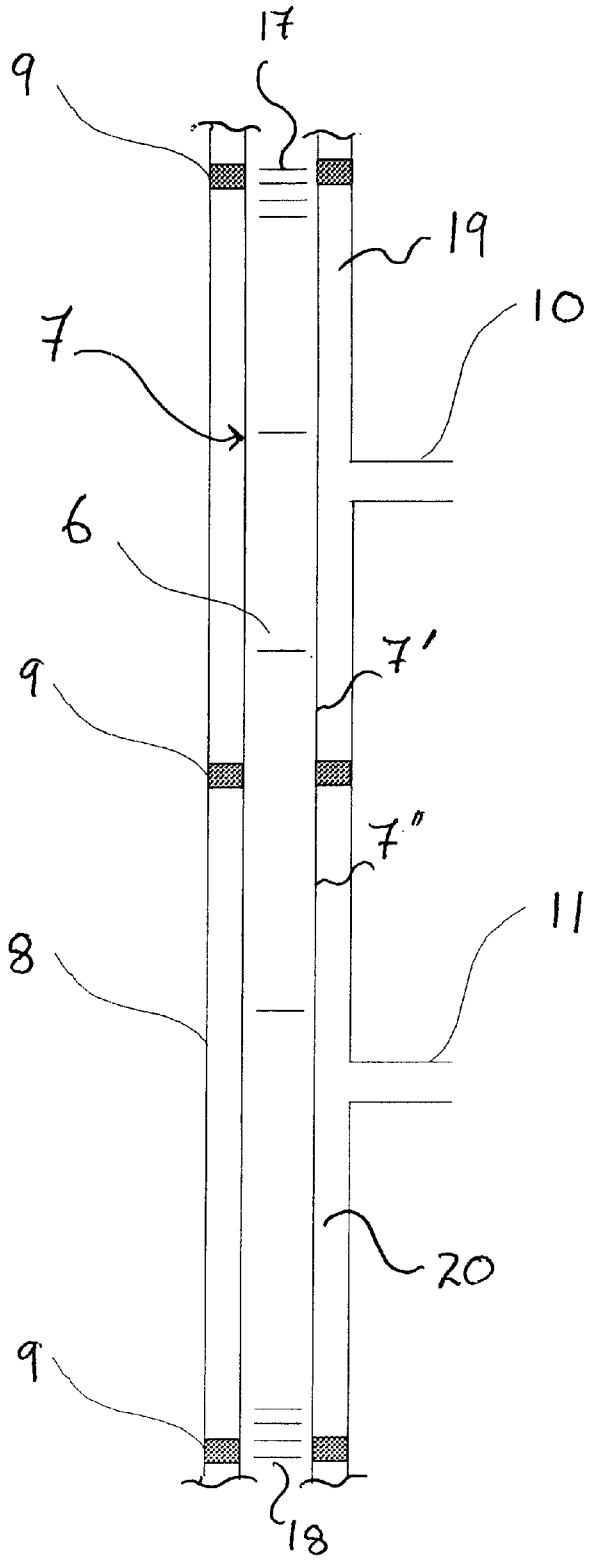
FIG. 2 is a sectional view of apparatus constructed according to the invention.

Apparatus for monitoring a sandscreen, constructed in accordance with the invention, is illustrated schematically in FIG. 2. The apparatus comprises an optical fibre 6, a region of which is shown in FIG. 2, having an integral pressure sensor indicated generally by the reference numeral 7. Reflectors 17, 18 are incorporated at each end of the pressure sensor. The reflectors preferably take the form of Bragg fibre gratings, which can simply be etched into the fibre. The fibre 6 is housed within a capillary tube 8 for protection. Annular seals 9 are provided between the fibre 6 and the capillary tube 8, at regular points along the length of the sensor 7 in order to divide the sensor into sections having respective chambers. In this case, the sensor is divided into two sections 7', 7" having chambers 19, 20.

In this embodiment of the invention, the pressure sensor 7 takes the form of a laser cavity. The performance of a laser cavity is affected by applied pressure on the fibre. A pump light source (not shown) is arranged to inject light into the fibre. The fibre has inlet ports 10 and 11, which open into the chambers 19, 20 associated with the sections of the cavity. A differential pressure applied between the ports 10, 11 causes a change in the section profile of the laser cavity. This, in turn, causes a change in the modal path length of the fibre which can be sensed by processing the light signal received at the end of the fibre. In this manner, the cavity can be calibrated to measure differential pressure.

Figure 3:
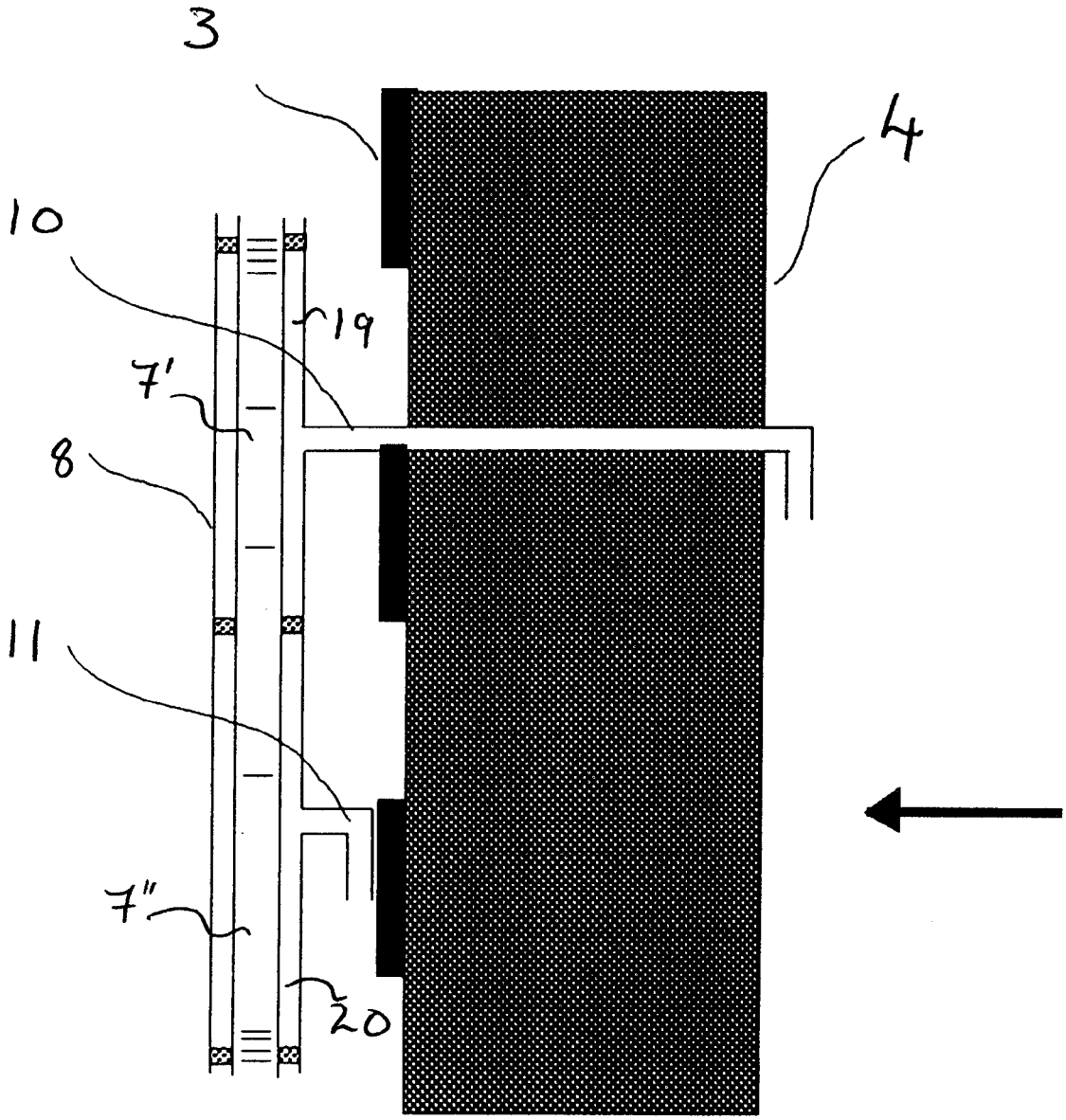
FIG. 3 is a sectional view of the apparatus of FIG. 2 in use.

FIG. 3 shows the apparatus of FIG. 2 in use, monitoring a sandscreen 3. In this arrangement, the optical fibre is mounted adjacent the inner surface of the sandscreen. The direction of fluid flow through the sandscreen is indicated by the arrow. The inlet port 10 extends through the sandscreen and terminates just beyond the outer surface of the sandscreen i.e. the port 10 terminates upstream of the sandscreen. Port 11 terminates close to the inner surface of the screen i.e. downstream of the sandscreen. The port 10 is exposed to the pressure of inflowing fluid prior to its encounter with the sandscreen 3. Port 11 is exposed to the pressure of the fluid as it emerges from the sandscreen. Thus, the sensor measures the pressure across the screen at that particular location. An increase in differential pressure could be indicative of a blockage in the sandscreen.

Figure 4:
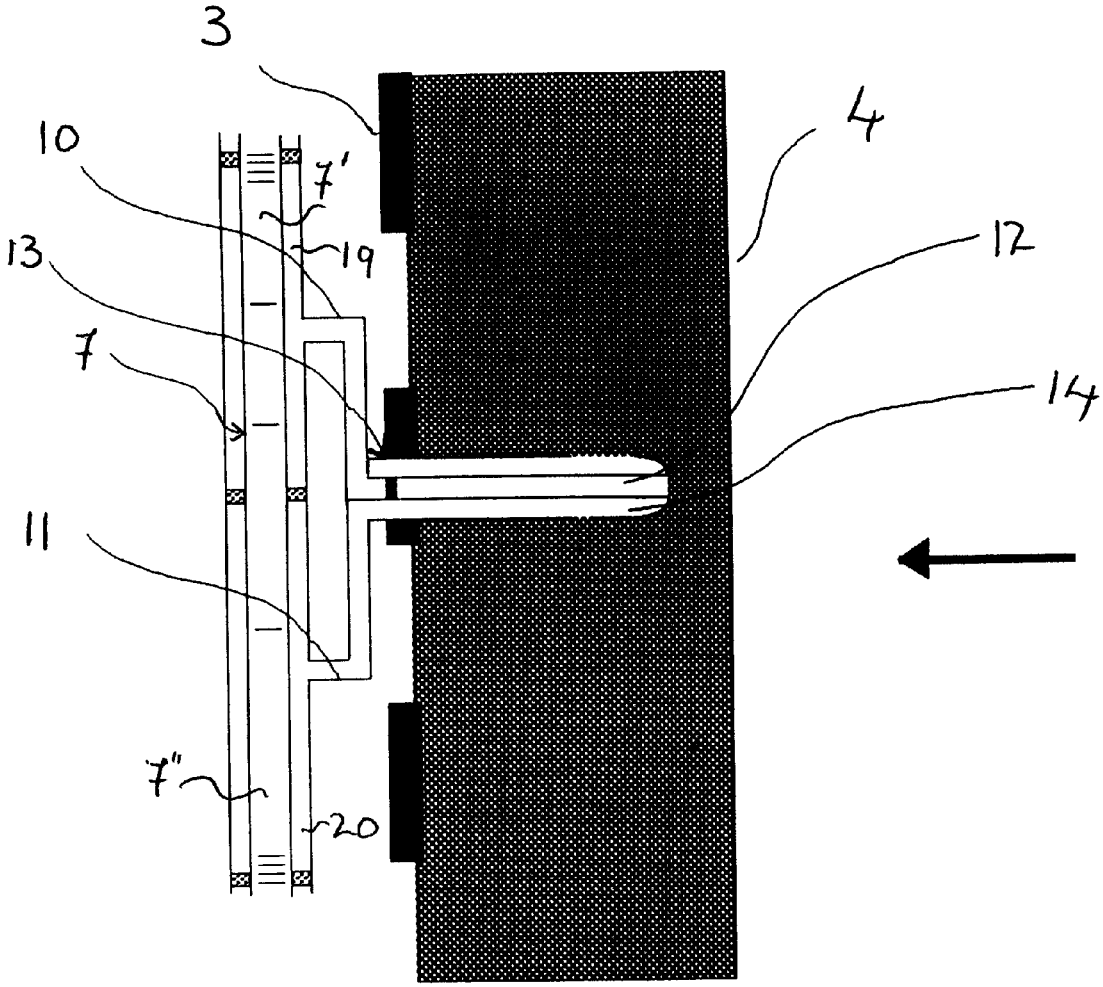
FIG. 4 is a sectional view of an alternative embodiment of the invention in use.

FIG. 4 illustrates an alternative embodiment of the invention. In this arrangement, port 10 is connected to the inner tube 12 of a pitot tube 13 embedded in the gravel 4 of the sandscreen 3. The pressure at this port varies with the velocity of the inflowing fluid and with static pressure. Port 11 of the sensor is connected to the outer tube 14 of the pitot tube and senses static pressure only. Thus, the differential pressure at the sensor is due only to the fluid velocity through the sandscreen 3. In this manner, the sensor measures velocity of the fluid flowing through the sandscreen. A change in measured velocity is indicative of a problem with the screen.

Figure 5:
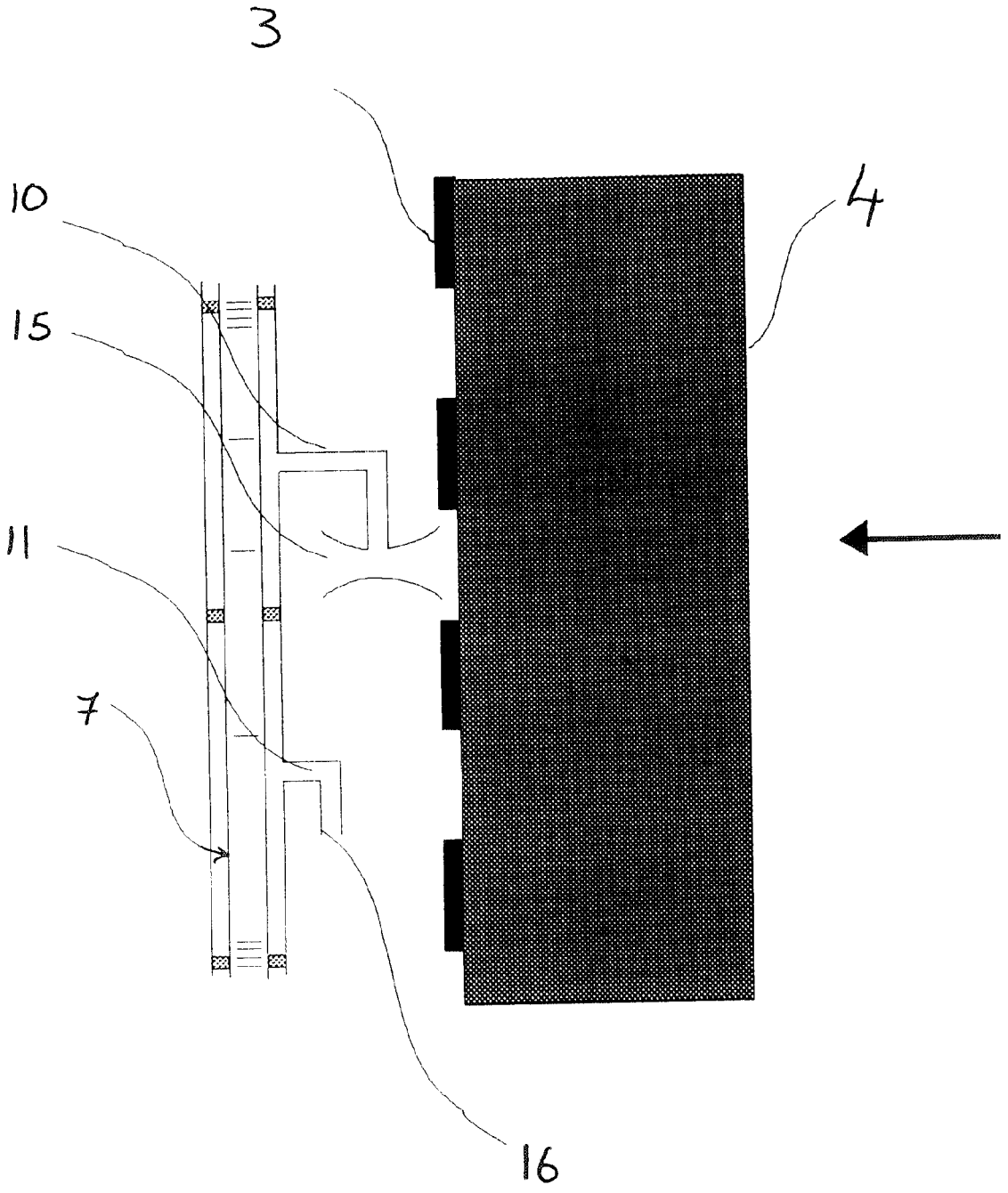
FIG. 5 shows a sectional view of a further alternative embodiment of the invention in use.

Another alternative arrangement is shown in FIG. 5. In this arrangement, port 10 is connected to a venturi tube 15 (not shown to scale) located close to the inner surface of the screen. A sample of the emerging fluid flows through the venturi 15. The pressure at this port varies with fluid velocity and with static pressure. The venturi tube shown is a so-called negative venturi because the pressure decreases with increase of fluid velocity. Of course, a positive venturi, which exhibits a pressure increase with decreasing fluid velocity, may be employed. Port 11 of the sensor is connected to a tube 16 arranged orthogonally to the flow direction. Thus, this port senses static pressure only. The differential pressure detected by the sensor is due to fluid velocity through the screen near the sensor location. This arrangement is advantageous over that shown in FIG. 4 because it is less prone to possible blockage by contaminants. The sensor as a whole can also be more easily integrated into the screen itself. Furthermore, the venturi tube may be incorporated into the sandscreen, in the case of the sandscreen comprising a perforated tube.

FIG. 6 shows yet another alternative embodiment, in which the optical fibre 6 comprises a plurality of pressure sensing sections 7, such as those illustrated in FIG. 5. Each section senses fluid velocity in the adjacent region of sandscreen. The sensing light signals from each of the pressure sensors 7 may be processed by techniques known to the skilled person, in order to produce a velocity profile of the fluid, along the extent of the sandscreen. In this drawing, all of the pressure sensing sections are identical, but of course any combination of the various alternative embodiments described above could be employed.

Figures 6B, 6C:
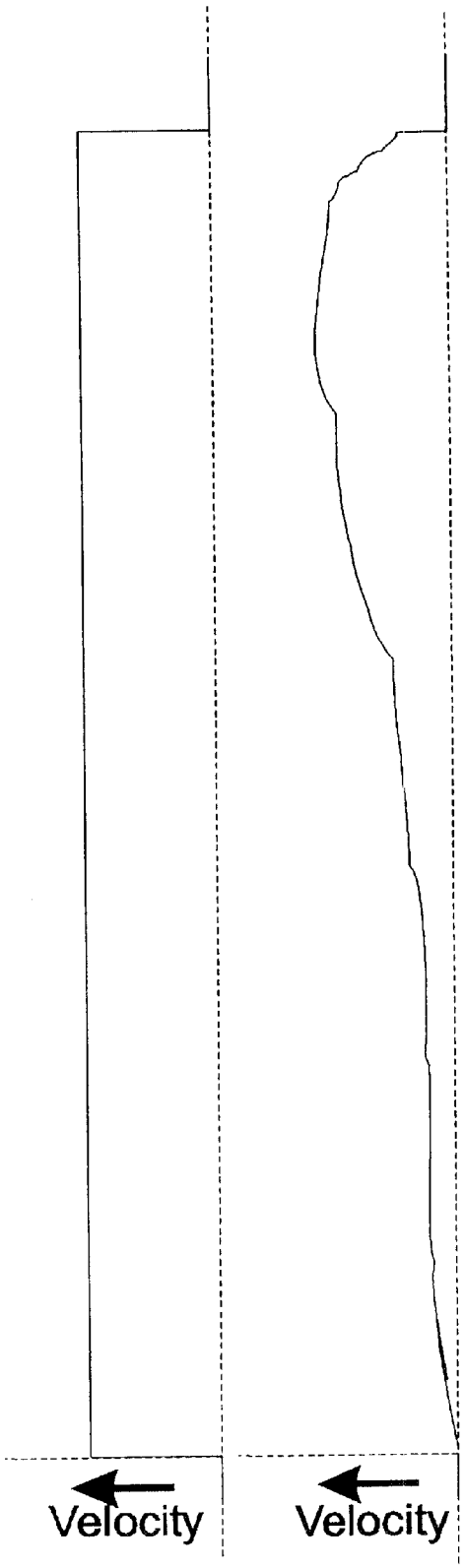
FIG. 6B shows an ideal velocity profile for the sandscreen.
FIG. 6C illustrates an actual velocity profile as measured by the apparatus of FIG. 6A.

FIG. 6B shows the ideal velocity profile for a sandscreen. The ideal situation is that the velocity of the inflowing fluid is the same along the extent of the sandscreen.

Figure 6A:
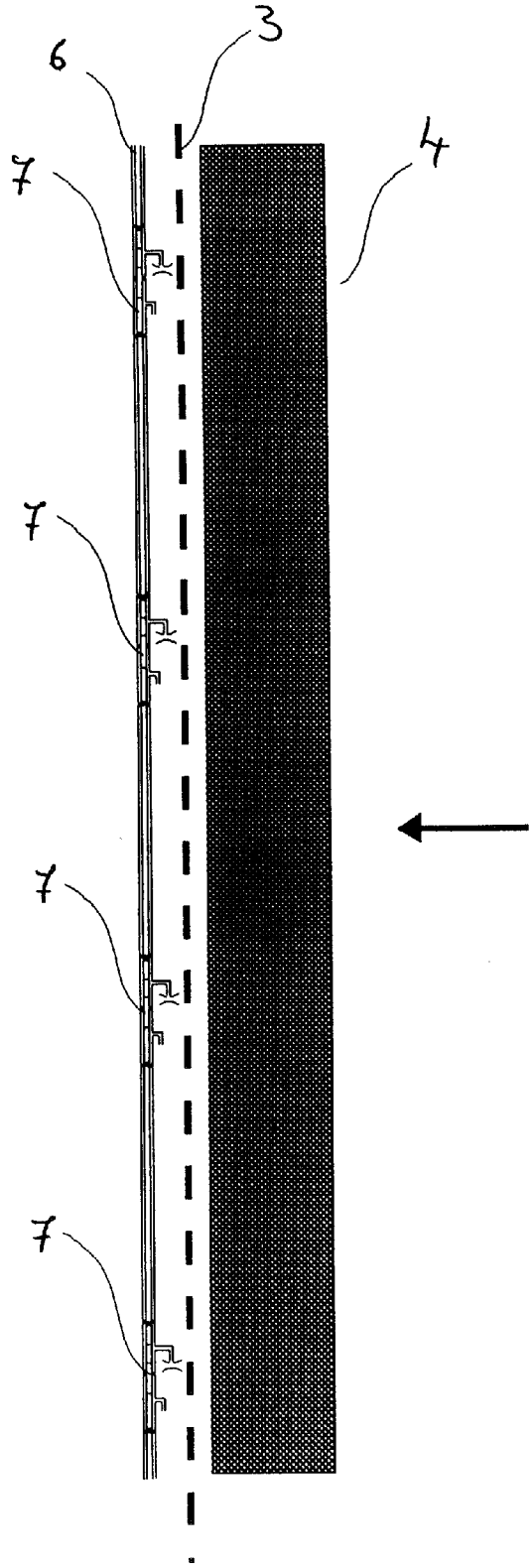
FIG. 6A is a sectional view of a region of sandscreen incorporating a plurality of the apparatus of FIG. 5.
Figure 7:
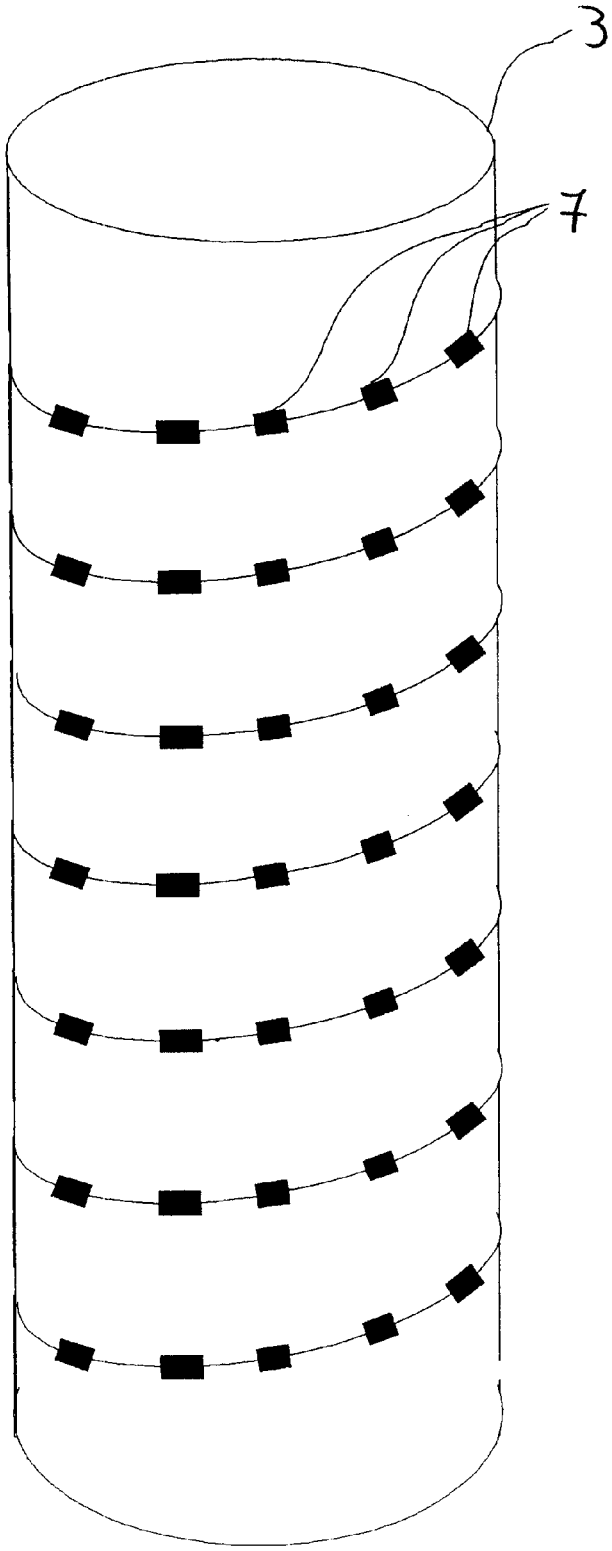
FIG. 7 illustrates a possible arrangement of the apparatus of FIG. 6A.

The apparatus of FIG. 6A includes only four pressure sensing sections. In practice, because the sandscreen is cylindrical, samples of the pressure across (or the velocity through) the sandscreen over the whole cylinder are required. As illustrated in FIG. 7, this can typically be achieved by a single optical fibre helically wound around the outer circumference of the sandscreen, along its length. The fibre incorporates a large number of pressure sensing sections, which are indicated by squares in this drawing although, in reality, they would not be visible. Indeed, the optical fibre could be incorporated in the wire mesh or perforated tube of the sandscreen itself. More than one fibre may be used to cover the area of the screen.

Further variations may be made without departing from the scope of the invention. For example, the apparatus may be used to monitor flow through any form of apparatus acting as a filter. As a further benefit, the sensor system of the present invention could be used in conjunction with other intelligent well hardware, such as remotely controlled chokes, in order to optimise well performance.

What is claimed is:

1. An apparatus for monitoring a condition of a filter in a fluid well system, the apparatus comprising:

a) an optical fiber incorporating a plurality of pressure sensors, each for monitoring a separate adjacent region of the filter and each responsive to a light signal transmissible through the fiber and to pressure exerted on it by fluid flowing through the filter at the respective region so that each sensor is operative for producing a sensing light signal indicative of a characteristic of a filter fluid flow of the respective region in a vicinity of the sensor; and b) processing means for processing respective sensing light signals, corresponding to different regions of the filter, to produce data indicative of the condition of the filter across said regions thereof.

2. The apparatus as claimed in claim 1, in which each pressure sensor is a laser cavity.

3. The apparatus as claimed in claim 2, in which the laser cavity comprises two sections having respective pressure chambers, each chamber being in pressure transfer with the fluid.

4. The apparatus as claimed in claim 3, in which each chamber is in pressure transfer with the fluid at different respective locations, so that the respective sensor is responsive to differential pressure associated with fluid pressure at the respective locations, each sensor being operative for producing the sensing light signal indicative of the differential pressure.

5. The apparatus as claimed in claim 4, in which one of the chambers is in pressure transfer with fluid upstream from the filter, and in which the other of the chambers is in pressure transfer with fluid downstream from the filter.

6. The apparatus as claimed in claim 3, in which one of the chambers is in pressure transfer with an inner tube of a pitot tube, and in which the other of the chambers is in pressure transfer with an outer tube of the pitot tube, each sensor being operative for producing the sensing light signal indicative of a velocity of fluid flow adjacent the respective sensor.

7. The apparatus as claimed in claim 6, in which the pitot tube is located within the filter.

8. The apparatus as claimed in claim 3, in which one of the chambers is in pressure transfer with a venturi tube substantially axially aligned with a direction of fluid flow adjacent the respective sensor, and in which the other of the chambers is in direct pressure transfer with a third chamber arranged substantially orthogonal to the direction of fluid flow adjacent the respective sensor, and in which the venturi tube and the third chamber are located downstream of the filter, each sensor being operative for producing the sensing light signal indicative of a velocity of fluid flow adjacent the respective sensor.

9. The apparatus as claimed in claim 1, in which each sensor includes end reflectors.

10. The apparatus as claimed in claim 9, in which the end reflectors comprise Bragg gratings.

11. The apparatus as claimed in claim 1, in which the optical fiber is wound in a spiral form around a surface of the filter such that the sensors are adjacent the different regions of the filter, both radially and longitudinally along an extent of the filter.

12. The apparatus as claimed in claim 1, in which the processing means is operative for producing a profile of flow velocities at the different regions of the filter for comparison with a profile of flow velocities for an ideal filter, thereby indicating blockage and an extent of the blockage at any of the different regions of the filter.

13. A filter incorporating an apparatus for monitoring a condition of the filter in a fluid well system, the apparatus comprising:

a) an optical fiber incorporating a plurality of pressure sensors, each for monitoring a separate adjacent region of the filter and each responsive to a light signal transmissible through the fiber and to pressure exerted on it by fluid flowing through the filter at the respective region so that each sensor is operative for producing a sensing light signal indicative of a characteristic of a filter fluid flow of the respective region in a vicinity of the sensor; and b) processing means for processing respective sensing light signals, corresponding to different regions of the filter, to produce data indicative of the condition of the filter across said regions thereof.

14. A fluid well system including an apparatus for monitoring a condition of a filter in the system, the apparatus comprising:

a) an optical fiber incorporating a plurality of pressure sensors, each for monitoring a separate adjacent region of the filter and each responsive to a light signal transmissible through the fiber and to pressure exerted on it by fluid flowing through the filter at the respective region so that each sensor is operative for producing a sensing light signal indicative of a characteristic of a filter fluid flow of the respective region in a vicinity of the sensor; and b) processing means for processing respective sensing light signals, corresponding to different regions of the filter, to produce data indicative of the condition of the filter across said regions thereof.

15. A method of monitoring a condition of a filter in a fluid well system, comprising the steps of:

a) transmitting a light signal through an optical fiber incorporating a plurality of pressure sensors, and arranging for each of the sensors to be in pressure transfer with fluid flowing through a different separate region of the filter so that each of the sensors produces sensing light signals indicative of a characteristic of a fluid flow in a vicinity of the sensor; and b) processing the signals to produce data indicate of the condition of the filter across said regions thereof.

* * * * *